US010450187B2

(12) United States Patent
Merrill

(10) Patent No.: US 10,450,187 B2
(45) Date of Patent: Oct. 22, 2019

(54) HORSE BRIDLE BIT AND METHOD OF USE

(71) Applicant: Neil Merrill, Axtell, UT (US)

(72) Inventor: Neil Merrill, Axtell, UT (US)

( * ) Notice: Subject to any disclaimer, the term of this patent is extended or adjusted under 35 U.S.C. 154(b) by 176 days.

(21) Appl. No.: 15/856,378

(22) Filed: Dec. 28, 2017

(65) Prior Publication Data

US 2019/0202683 A1 Jul. 4, 2019

(51) Int. Cl.
*B68B 1/06* (2006.01)
*B68B 1/04* (2006.01)

(52) U.S. Cl.
CPC . *B68B 1/06* (2013.01); *B68B 1/04* (2013.01)

(58) Field of Classification Search
CPC .. B68B 1/06; B68B 1/04; B68B 99/00; B68B 5/06; B68B 5/00
See application file for complete search history.

(56) References Cited

U.S. PATENT DOCUMENTS 295,028 A * 3/1884 Longcor ..... B68B 1/06 54/9
773,429 A * 10/1904 Sievertt ..... B68B 1/06 54/7
2,193,451 A * 3/1940 Fryer ..... B68B 1/06 54/7
2002/0139094 A1* 10/2002 Jonsson ..... B68B 1/06 54/7
2003/0074869 A1* 4/2003 Balding ..... B68B 1/06 54/8

OTHER PUBLICATIONS

Curb Bits—Gene Klein Custom Silver Finery website; http://www.geneklein.com/curb-bits.html. (Year: 2016).*

* cited by examiner

*Primary Examiner* — Daniel J Colilla
(74) *Attorney, Agent, or Firm* — J. Todd Rushton

(57) ABSTRACT

The disclosure of the present invention relates to a HORSE BRIDLE BIT or more specifically to a horse bridle bit having a mouthpiece and independently movable shanks connected using a pinch-free ball joint assembly and the shank top ring having a relief joint to reduce contact pressure to the horses jaw when the bit shank is manipulated laterally. The bit configured to convey clear communication to the horse without undue encroachment in the mouth or jaw.

18 Claims, 5 Drawing Sheets

HORSE BRIDLE BIT AND METHOD OF USE

SUMMARY OF THE INVENTION

The disclosure of the present invention relates to a HORSE BRIDLE BIT or more specifically to a horse bridle bit having a mouthpiece and independently movable shanks connected using a pinch-free ball joint assembly and the shank top ring having a relief joint to reduce contact pressure to the horses jaw when the bit shank is manipulated laterally. The bit configured to convey clear communication to the horse without undue encroachment in the mouth or on the jaw; the elimination of pinching and other sources of discomfort provide a content, predictable and controllable horse. The bridle bit of the present invention is a preferable bit for recreation or casual riding, but is primarily configured for a working horse subject to aggressive commands and direction changes during activities such as heading livestock, roping or barrel racing.

A first embodiment of the present invention or horse bridle bit comprising a mouthpiece and side shanks connected with a moveable joint configured as a spherical pin attached into the shanks and a ring formed into the corresponding ends of the mouthpiece. The mouthpiece can be a single bar style bit, but the design of the present invention is particularly effective for manipulating a multi-part mouthpiece such as a snaffle or curb bit having a port. The full side shanks having an overall length, with approximately two-thirds of the length being substantially linear with a rein loop formed in the free-end, the shank having an approximately 45 degree downturn bend where the remaining one-third of the shank forms a purchase portion. The free end of the purchase portion having a top ring; in one embodiment there is a single top ring. In another embodiment there are two independent rings, an upper ring configured to attach the headstall and a lower ring configured to attach a curb strap or curb chain.

The spherical pin and ring configuration creates the secure union between the mouthpiece and the shanks. The shank is formed having an irregular opening configured to receive the spherical pin and a mouthpiece end ring. The opening having a substantially circular central portion just larger than the diameter of the spherical pin and having semicircular cutouts proximate the equator of the circular portion; this can easily be visualized as a cutout in the shape of the planet Saturn's profile. The tolerances of the cutout on the inside surface of the side shank are narrow in order to prevent the horse's lip from being pinched when the joint moves. However, the cutout tapers out, from inside dimensions to the outside dimensions, with a more open tolerance on the outside surface of the side shank. This provides a relief space between the side shank and the end portion of the mouthpiece ring and allows for movement of the mouthpiece away from the equatorial axis. The relief space between mouthpiece ring and the side shank can be adjusted in order to change the performance of the bit. Open clearances allow the mouthpiece to "float" or move unrestricted through a greater range of motion inside of the horse's mouth. Whereas, if the clearance is narrowed, the side bars of the mouthpiece will be restricted to a position more substantially perpendicular to the side shanks and will translate subtle motions conveyed via the reins directly into the horse's mouth.

While the spherical pin and mouthpiece ring does allow for free play or float between the mouthpiece and the side shanks it is also configured to convey direct signals to the horse when the shank is pulled down with the reins. When the front of the shank is moved down, the spherical pin creates a direct rotation of the mouthpiece end ring and will cause the mouthpiece side bar to move down and engage the horse's tongue, conveying a clear and direct signal to the horse. If a curb bit is used, this rotation will cause both of the side bars to move down while the port portion will rotate up into a standing position in the horse's mouth.

In one embodiment of the present invention, end rings of the mouthpiece may include an additional stop or stops in order to again adjust the performance of the bridle bit. The stops may be a step, rise, knob or bump positioned on the outside diameter of the end ring in order to provide a positive contact point between the mouthpiece end ring and the outside surface of the side shank. A stop on the back position of the end ring can be set to contact the side shank in order to prevent a multi-part bit from falling to far forward in the horse's mouth when their head is in a down position. A stop on the forward position of the end ring can be set in order to engage the bit side bar when the horse is reined into a turn. It is contemplated that the position of theses stops can be modified to fit rider preference, suit riding style such a barrel racing, reining horse training and roping, or may even be adjusted to the disposition of a particular horse.

In yet another embodiment of the present invention or horse bridle bit, the purchase portion side shank includes a moveable joint just below the top ring portion. The moveable joint is configured to allow the top ring portion to release, or bend flush, when the ring comes in contact with the outside of the horse's jaw just in front of the cheek. The joint is set on a biased angle to the main linear axis of the purchase portion of the side shank and is set in a substantially vertical position when the bit is resting in a neutral position. In this position the top ring portion will be held in a linear position or in on the same plane as the length of the side shank by the headstall and the drape of the curb chain. However, when the side shanks of the bit are manipulated downward in tandem, as during a whoa command, or more particularly, when a side shank is manipulated down and away, or laterally to the side, in an aggressive turn command, the purchase portion of the side shank will pivot up and into the outside of the horse's jaw but the top ring will lay flat or conform to the side of jaw along the line of the moveable joint. This position allows for more aggressive rein commands without having the top ring portion encroaching on the horse's jaw and causing unnecessary pain or discomfort for the horse.

BRIEF DESCRIPTION OF DRAWINGS

The following description of the embodiments can be understood in light of the Figures which illustrate specific aspects of the embodiments and are part of the specification. Together with the following description, the Figures demonstrate and explain the principles of the embodiments. In the Figures the physical dimensions of the embodiment may be exaggerated for clarity. The same reference numerals or word descriptions in different drawings represent the same element, and thus their descriptions may be omitted.

DETAILED DESCRIPTION OF DRAWINGS

Figure 1:
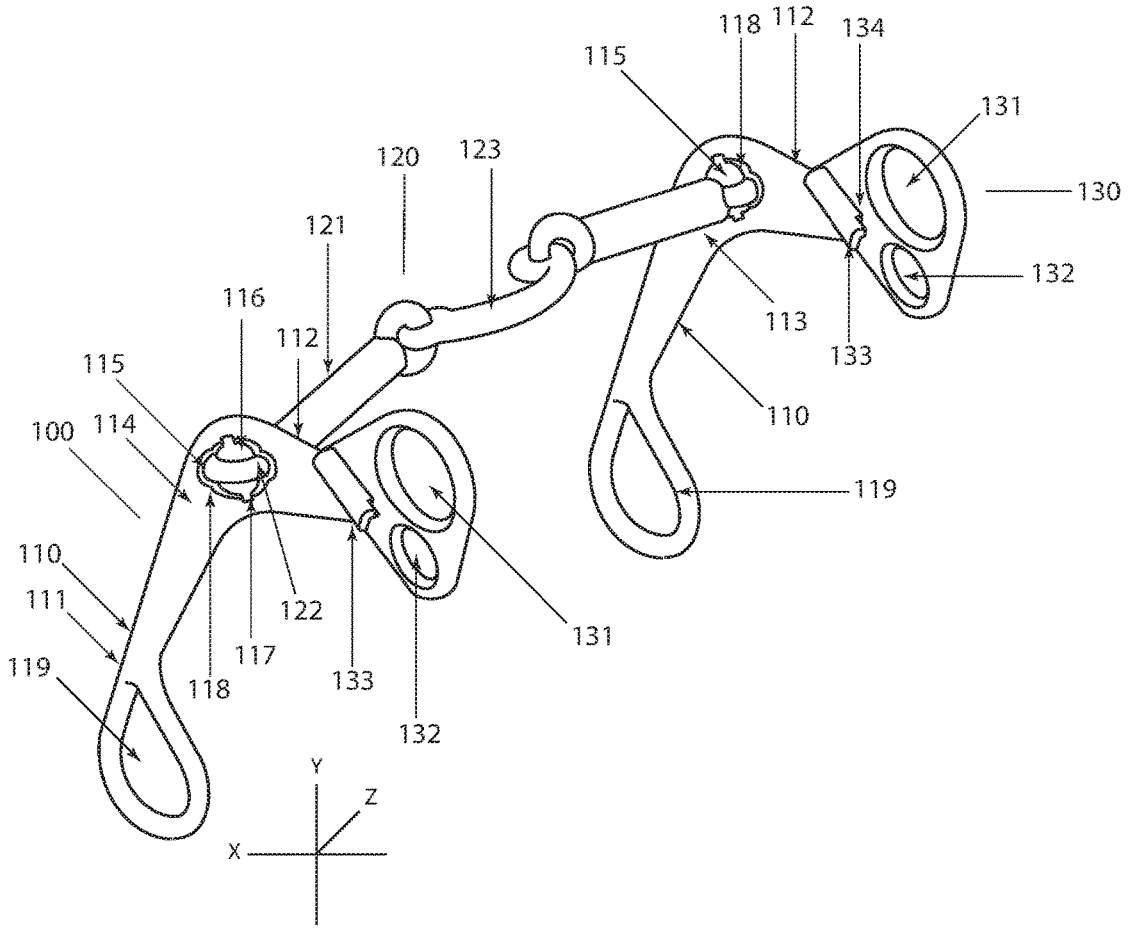
FIG. 1, a perspective view of a horse bridle bit.

For the purposes of promoting an understanding of the principles in accordance with the disclosure, reference will now be made to the embodiments illustrated in the drawings and specific language will be used to describe the same. It will nevertheless be understood that no limitation of the scope of the disclosure is thereby intended. Any alterations and further modifications of the inventive features illustrated herein, and any additional applications of the principles of the disclosure as illustrated herein, which would normally occur to one skilled in the relevant art and having possession of this disclosure, are to be considered within the scope of the disclosure claimed.

In describing and claiming the present disclosure, the following terminology will be used in accordance with the definitions set out below. As used in this specification and the appended claims, the singular forms "a," "an," and "the" include plural referents unless the context clearly dictates otherwise. As used herein, the terms "comprising," "including," "containing," "characterized by," "having," and grammatical equivalents thereof are inclusive or open-ended terms that do not exclude additional, unrecited elements or method steps.

The present invention will be described more fully hereinafter with reference to the accompanying drawings, which illustrate embodiments of the invention. This invention may, however, be embodied in many different forms and should not be construed as limited to the illustrated embodiments set forth herein. Rather, these embodiments are provided so that this disclosure will be thorough and complete, and will fully convey the scope of the invention to those skilled in the art.

Figure 2:
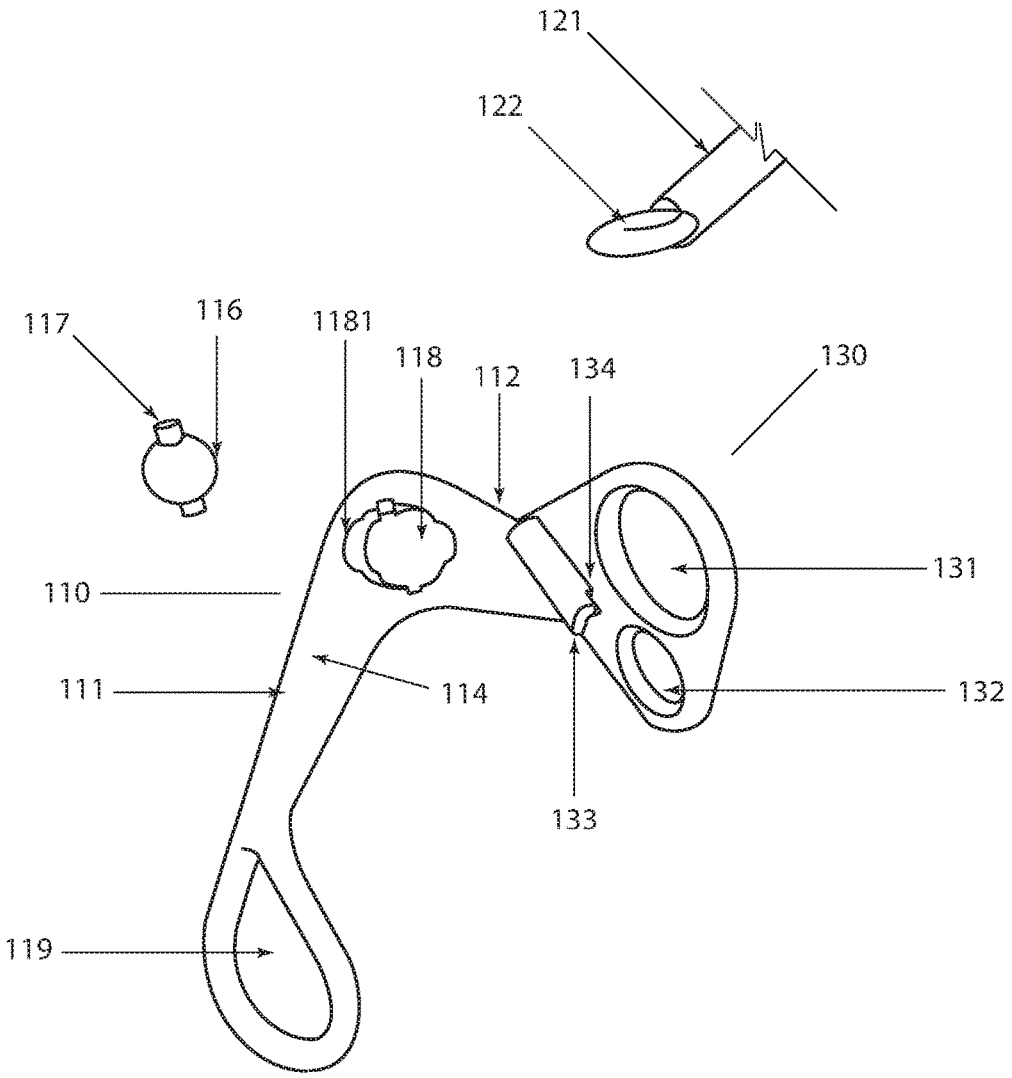
FIG. 2, an exploded view of the mouthpiece joint of the horse bridle bit.

A first embodiment of the present invention or horse bridle bit 100, shown in FIGS. 1 and 2, including side shanks 110 having an articulating mouthpiece 120 attached using a moveable joint 115. The side shanks 110, including a shank portion 111and a purchase portion 112 offset from the shank portion 111 by approximately 45 degrees. The side shanks 110 also having a defined inside surface 113 and outside surface 114. Moveable joint 115 is formed at the offset junction between the shank portion 111 and the purchase portion 112. Moveable joint 115 including a spherical pin 116, having attachment pins 117; side bar 121 of mouthpiece 120 including an end ring 122 configured to encompass the spherical pin 116. The moveable joint assembly 115 is fitted into a joint cutout 118 formed in the side shanks 110. The joint cutout 118 having a generally circular shape to accommodate spherical pin 116 and having semi-circular ring cut-outs 1181 formed along the equatorial axis of the spherical pin 116 configured to accommodate the end ring 122. The joint cutout 118 also including pockets configured to receive the attachment pins 117 which are pressed, soldered, welded or otherwise attached to the side shanks 110. Joint cutout 118 has a tapered profile through the side shank 110 with a narrow tolerance formed on the inside surface 113 of side shank 110 and more open tolerances formed at the outside surface 114 in relationship to the moving parts of moveable joint 115. The narrow tolerances at the inside surface 113 prevent the joint from pinching the skin on the horse's lip. Generally moveable joint 115 is configured to allow for a tilting articulation of the mouthpiece side bar 121 away from a position perpendicular to the plane formed by an X axis through the equator of the spherical pin 116, and along the main longitudinal axis of the purchase portion 112 of the side shank 110, and a Y axis corresponding to the vertical axis formed by the attachment pins 117. The spherical pin 116 and end ring 122 engagement fully prevents the mouthpiece side bar 121 from pulling away from the side shank 110 or out of the plane formed by the X and Y axis along a third Z axis. The open tolerances between the side shank 110 at the outside surface 114 allows for greater tilting articulation of the mouthpiece side bar 121 in an axis perpendicular to the longitudinal axis of the side shank 110. Changing the outside tolerances of the joint cutout 118 allows for modification of the bit characteristics; a more open tolerance allows for a "free floating" mouthpiece 120 whereas, when the tolerances are narrowed, the side bar 121 will move readily, reflecting any subtle motion imparted by the reins to the side shank 110. Rotation downward of the side shank 110 around the Z axis creates a corresponding rotation of the mouthpiece side bar 121; end ring 122 is configured to engage the surface of the ring cutout 1181and will impart any rotational movement of the side shank 110 into the side bar 121 of the mouthpiece 120.

Mouthpiece 120 includes side bar 121, having ring ends 122 and a central link or port 123. It is contemplated that mouthpiece 120 may also be a single bar bit or a single bar including one or more offset portions or shapes.

The free end of the shank portion 111including a rein ring 119 and the free end of the purchase portion 112 including a top ring 130. In one embodiment there may be a single top ring, however, in another embodiment the top ring 130 may include an upper headstall ring 131 and a lower curb ring 132 for installation of a curb strap or chain. In yet another embodiment of the present invention, the top ring portion 130 is articulated using a relief joint 133 attached within a limit slot 134 formed in the purchase portion 112 of side shank 110. The relief joint 133 configured prevent the top ring 130 portion of the bit 100 from encroaching on the back of the horse's jaw, when the bit is aggressively manipulated during a turn.

Figure 3:
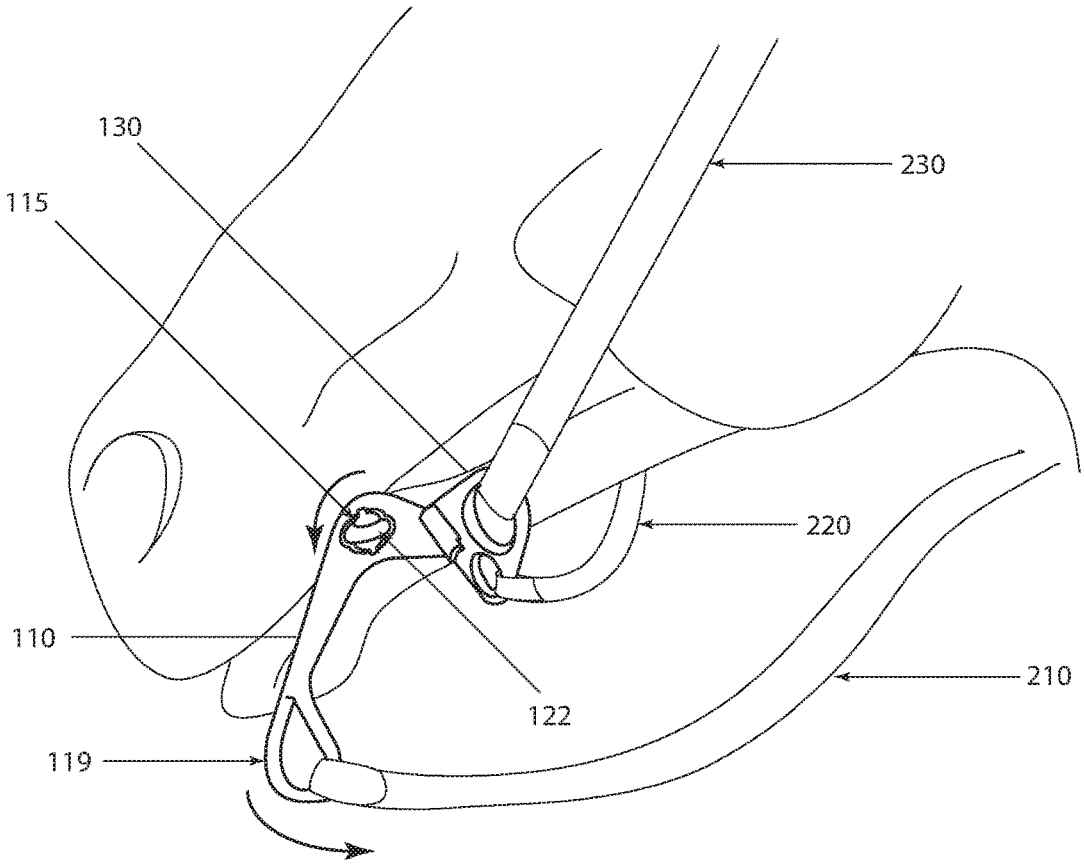
FIG. 3, a side view showing the articulation of the horse bridle bit.
Figure 4:
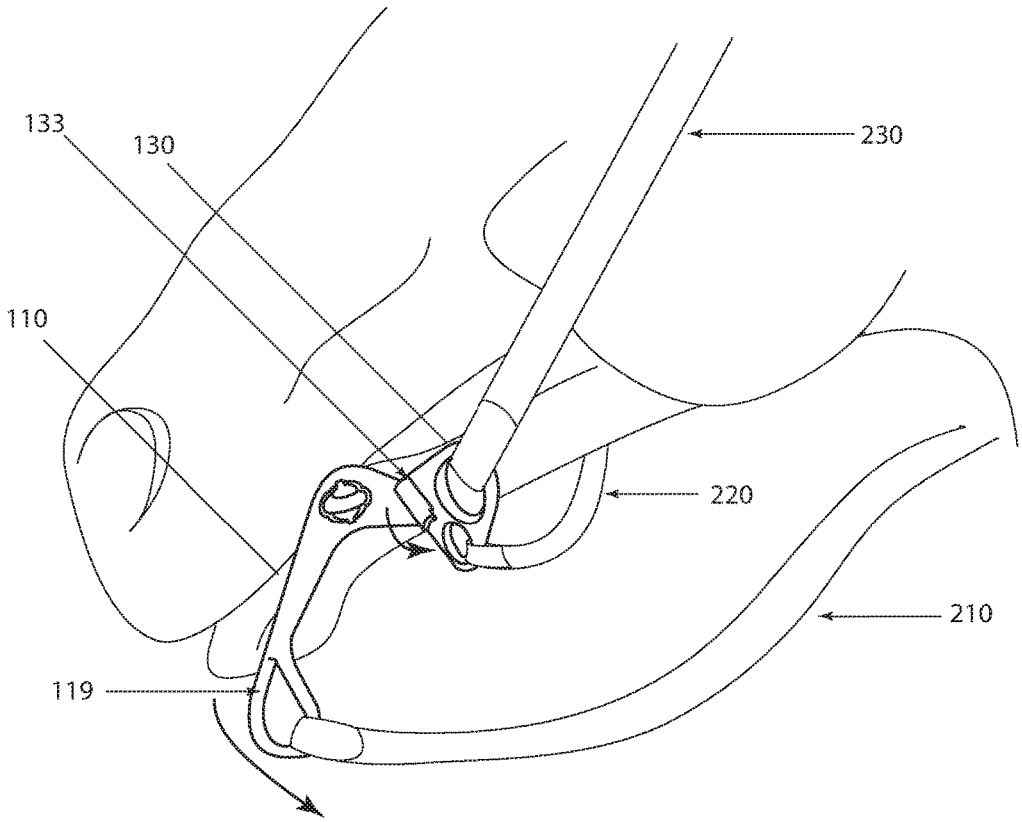
FIG. 4, a side view showing the articulation of the top ring of the horse bridle bit, FIG. 5A, a top view of the horse bridle bit, and, FIG. 5B, a top view of the horse bridle bit with articulation of the top ring.

The bridle bit 100 shown in FIGS. 3 and 4 is installed in horse mouth, including side shank 110 having a rein ring 119 and top ring 130. Reins 210 are installed at 119 and a headstall 230 and curb strap 220 are installed at top ring 130.

FIG. 3 is included to indicate that as reins 210 are pulled as in a whoa command, the end of the side shank 110 will move down and back creating a rotation at moveable joint 115. This rotation will be translated to the side bar 121 of the mouthpiece 120 and a cause a port 123 in the mouthpiece to stand, signaling the horse to whoa or to stop (see FIG. 1).

FIG. 4 indicates that as the reins 210 are pulled back and away from the horse's head, as in an aggressive turn, the rein end of side shank 110 will be pulled away, and the top ring 130 will be pressed in, toward the back of the horse's jaw, however, top ring 130 will give along relief joint 133 to prevent the top ring 130 from encroaching on the side of the horses jaw and teeth.

Figure 5A:
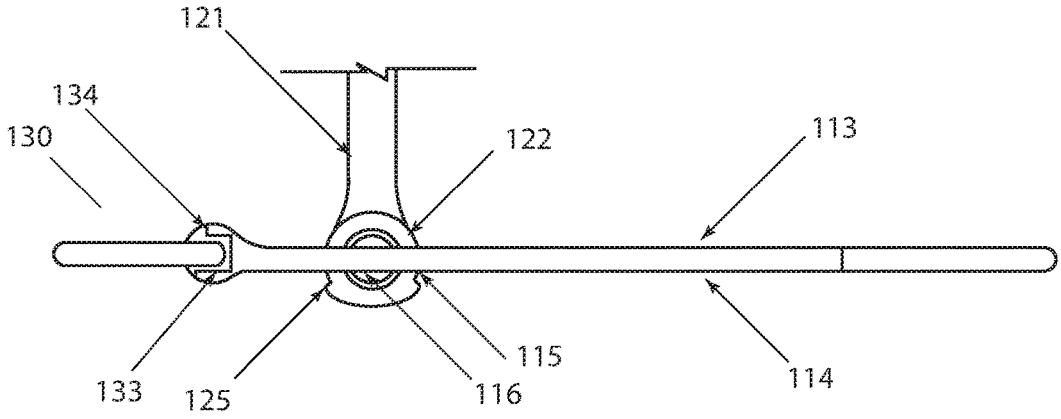
Figure 5B:
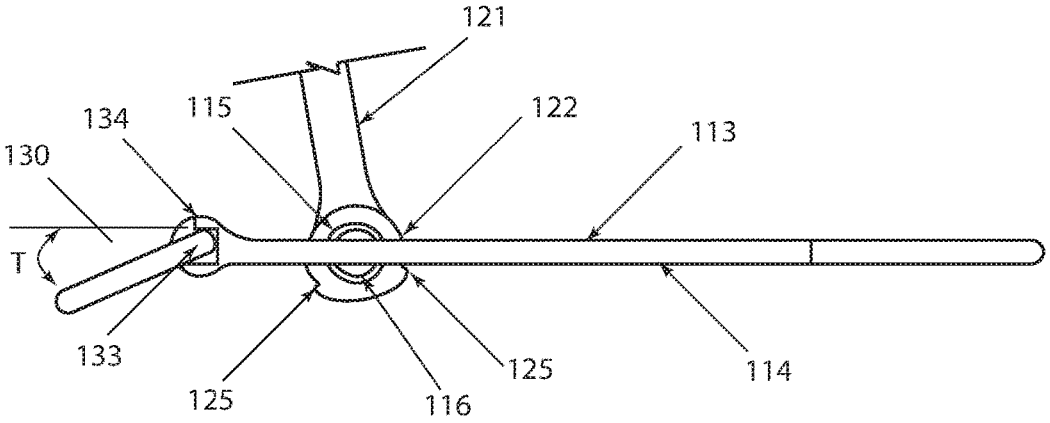

FIGS. 5A and 5B are a top view of one embodiment of the horse bridle bit side shank 110 having an inside surface 113 and outside surface 114, a moveable joint 115 and head ring 130. The moveable joint 115 including, spherical pin 116 and the side bar 121 with end ring 122. The end ring 122 having one or more control stops 125 configured to engage the outside surface 114 of the side shank 110 and to limit the motion of the mouthpiece side bars 121. The position of the stops 125 can be adjusted to change the response of the bit for a particular rider, riding style, discipline or horse. FIG. 5B shows the how top ring 130 can rotate around relief joint 133 to alleviate pressure by the top ring 130 on the back of the horse's jaw. The size of limit slot 134 is configured to hold the top ring 130 in line with side shank 110 but can be can also be adjusted depending on the desired overall deflection or relief angle T. The angle of the relief joint 133 and the size of the limit slot 134 can also be modified to correct the head position of a particular horse, for example when a horse drops their head to low, or over flexes their neck, during a turn, the angle of relief joint 133 and the size of limit slot 134 can be reduced and the horse will not be afforded as much relief unless their head is held higher or in a proper position.

The invention claimed is:

1. A horse bridle bit comprising;
a pair of side shanks,
each of the side shanks including,
a shank portion,
the free end of shank portion having a rein ring,
an offset purchase portion,
the free end of the purchase portion having a top ring,
an inside surface,
an outside surface, and,
a joint cut-out formed through the side shank between the shank portion and the purchase portion,
a spherical pin, and,
a mouthpiece having an end ring configured to fit over the spherical pin and in the joint cut-out forming a moveable joint between the side shank and the mouthpiece.

2. The bridle bit of claim 1 wherein the joint cut-out is tapered open from the inside surface of the side shank to the outside surface of the side shank.

3. The bridle bit of claim 1 wherein the clearance between the inside surface of the side shank and the spherical pin and end ring is narrow.

4. The bridle bit of claim 1 wherein the clearance between the outside surface of the side shank and the spherical pin and end ring is wider than the clearance between the inside surface of the side shank and the spherical pin and end ring.

5. The bridle bit of claim 1 wherein the range of motion of the moveable joint is adjustable by modifying the clearance between the outside surface of the side shank and the spherical pin and end ring.

6. The bridle bit of claim 1 wherein the joint cut-out includes a ring cut-out configured to allow engagement between the side shank and the end ring during rotational movement of the side shank.

7. The bridle bit of claim 1 wherein the end ring include one or more control stops configured to engage the outside surface of the side shank.

8. The bridle bit of claim 1 wherein the mouthpiece is a bar bit.

9. The bridle bit of claim 1 wherein the mouthpiece is a multi-piece bit.

10. The bridle bit of claim 1 wherein the mouthpiece is multi-piece bit having a port.

11. The bridle bit of claim 1 wherein the top ring includes a headstall ring and a curb ring.

12. The bridle bid of claim 1 including a relief joint formed in the purchase portion below the top ring.

13. The bridle bit of claim 12 wherein the relief joint is formed on biased angle through the purchase portion.

14. The bridle bit of claim 12 including a limit slot configured to control the relief angle of the relief joint.

15. A method of using a horse bridle bit comprising:
providing a horse bridle bit including;
a pair of side shanks,
each of the side shanks including,
a shank portion,
the free end of shank portion having a rein ring,
an offset purchase portion,
the free end of the purchase portion having a top ring,
a top ring relief joint,
the top ring relief joint including a limit slot having a width configured to control the deflection of the relief joint,
an inside surface,
an outside surface, and,
a joint cut-out formed through the side shank between the shank portion and the purchase portion,
the joint cut-out forming a taper that opens from the inside surface of the side shank to the outside surface of the side shank,
a spherical pin, and,
a mouthpiece having an end ring configured to fit over the spherical pin and in the joint cut-out forming a moveable joint between the side shank and the mouthpiece, and,
the end ring including at least one control stop configured to engage the outside surface of the side shank.

16. The method of claim 15 including adjusting the range of motion of the moveable joint by modifying the taper of the joint cut-out.

17. The method of claim 15 including adjusting the range of motion of the end ring by changing the position of the control stop.

18. The method of claim 15 including adjusting the angle of deflection of the top ring relief joint by modifying the width of the limit slot.

* * * * *